US007819753B1

(12) United States Patent
Galloway et al.

(10) Patent No.: US 7,819,753 B1
(45) Date of Patent: Oct. 26, 2010

(54) AERODYNAMIC CONTROL SURFACE ON A GOLF CLUB FOR TRAINING PURPOSES

(75) Inventors: J. Andrew Galloway, Escondido, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 12/629,751

(22) Filed: Dec. 2, 2009

Related U.S. Application Data

(60) Provisional application No. 61/140,780, filed on Dec. 24, 2008.

(51) Int. Cl.
*A63B 69/36* (2006.01)

(52) U.S. Cl. ..... 473/228; 473/226

(58) Field of Classification Search ..... 473/219, 473/226, 228, 229, 257
See application file for complete search history.

(56) References Cited

U.S. PATENT DOCUMENTS 5,002,275 A * 3/1991 Beutler et al. ..... 473/228
5,165,683 A * 11/1992 Beutler et al. ..... 473/228
5,207,625 A * 5/1993 White ..... 482/111
6,881,156 B1 * 4/2005 Phillips ..... 473/228
7,163,468 B2 1/2007 Gibbs et al.
7,163,470 B2 1/2007 Galloway et al.
7,166,038 B2 1/2007 Williams et al.
7,214,143 B2 5/2007 Deshmukh
7,252,600 B2 8/2007 Murphy et al.
7,258,626 B2 8/2007 Gibbs et al.
7,258,631 B2 8/2007 Galloway et al.
7,273,419 B2 9/2007 Evans et al.
7,413,520 B1 8/2008 Hocknell et al.
7,429,222 B2 9/2008 Tolson
7,568,979 B2 8/2009 Arnold, Sr.
7,572,192 B1 8/2009 Boyd
7,597,632 B2 10/2009 Edwards et al.
2003/0207719 A1 * 11/2003 Hughes ..... 473/228

* cited by examiner

*Primary Examiner*—Nini Legesse
(74) *Attorney, Agent, or Firm*—Michael A. Catania

(57) ABSTRACT

The present invention is a unique and improved training aid to assist the golfer in learning these skills. The invention has deployable fins that deploy during a backswing and retract during a downswing.

1 Claim, 4 Drawing Sheets

AERODYNAMIC CONTROL SURFACE ON A GOLF CLUB FOR TRAINING PURPOSES

CROSS REFERENCES TO RELATED APPLICATIONS

The present application claims priority to U.S. Provisional Patent Application No. 61/140,780, filed on Dec. 24, 2008.

STATEMENT REGARDING FEDERALLY SPONSORED RESEARCH OR DEVELOPMENT

Not Applicable

BACKGROUND OF THE INVENTION

1. Field of the Invention

The present invention relates to a golf club. More specifically, the present invention relates to golf club training.

2. Description of the Related Art

The prior art discloses various training aids. One such example is U.S. Pat. No. 7,597,632 for Gold Putting Practice Aid which discloses an apparatus for guiding stroking movement of a putter, comprising a base frame engageable with and forming a border about a putting surface in an operative stroke practice position.

Another example is U.S. Pat. No. 7,572,192 issued to Boyd for Golf Swing Training Aid. This patent discloses the use of a "C"-shaped head rest that is positioned across the user's forehead and padded for comfort. The headrest is connected to an extendable shaft that varies in length from 4 feet long to 7 feet long. The headrest trains the golfer to maintain a proper head position during a golf swing.

Yet another example is U.S. Pat. No. 7,568,979 for Golf Swing Training Apparatus which discloses a mounting bar with an extendable length arm stabilizer extending outwardly from the mounting bar and terminating in a headrest.

Tolson, U.S. Pat. No. 7,429,222 for a Parallel Putting Device And Method discloses a putting aid using device to maintain the position of the putter during the putt.

Training an individual to golf is difficult. It is important to establish skill quickly and to reach a satisfactory level of performance. Equipment changes have improved many aspects of the game of golf, but the game is still difficult and requires goods skills to play well.

Many golfers are self taught or poorly taught and this limits the level of skill and satisfaction the golfer can achieve. Training is difficult due in part to the free constraints of golf swings, the large range of body motions required to achieve swings, combined with the importance of sequencing and timing of motions. Training aids are designed to provide reference and guidance to the golfer to experience components of the swings and the proper rate and sequence of these motions.

BRIEF SUMMARY OF THE INVENTION

The present invention overcomes these difficulties. The present invention is a unique and improved training aid to assist the golfer in learning these skills. The purpose of the present invention is to slow the back swing to help with sequence and timing. The present invention does not slow the down swing.

Additionally, the present invention is used to assist in the proper rate and sequence of the closing of the club face to the golf ball via rotation of the club. This invention triggers a torque that coerces the rotation by a helping torque.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention uses a self-deploying airbrake that is either symmetric with no torque, or anti-symmetric with preferential torque. A preferred embodiment includes both functions with the ability to control the combination.

Figure 1:
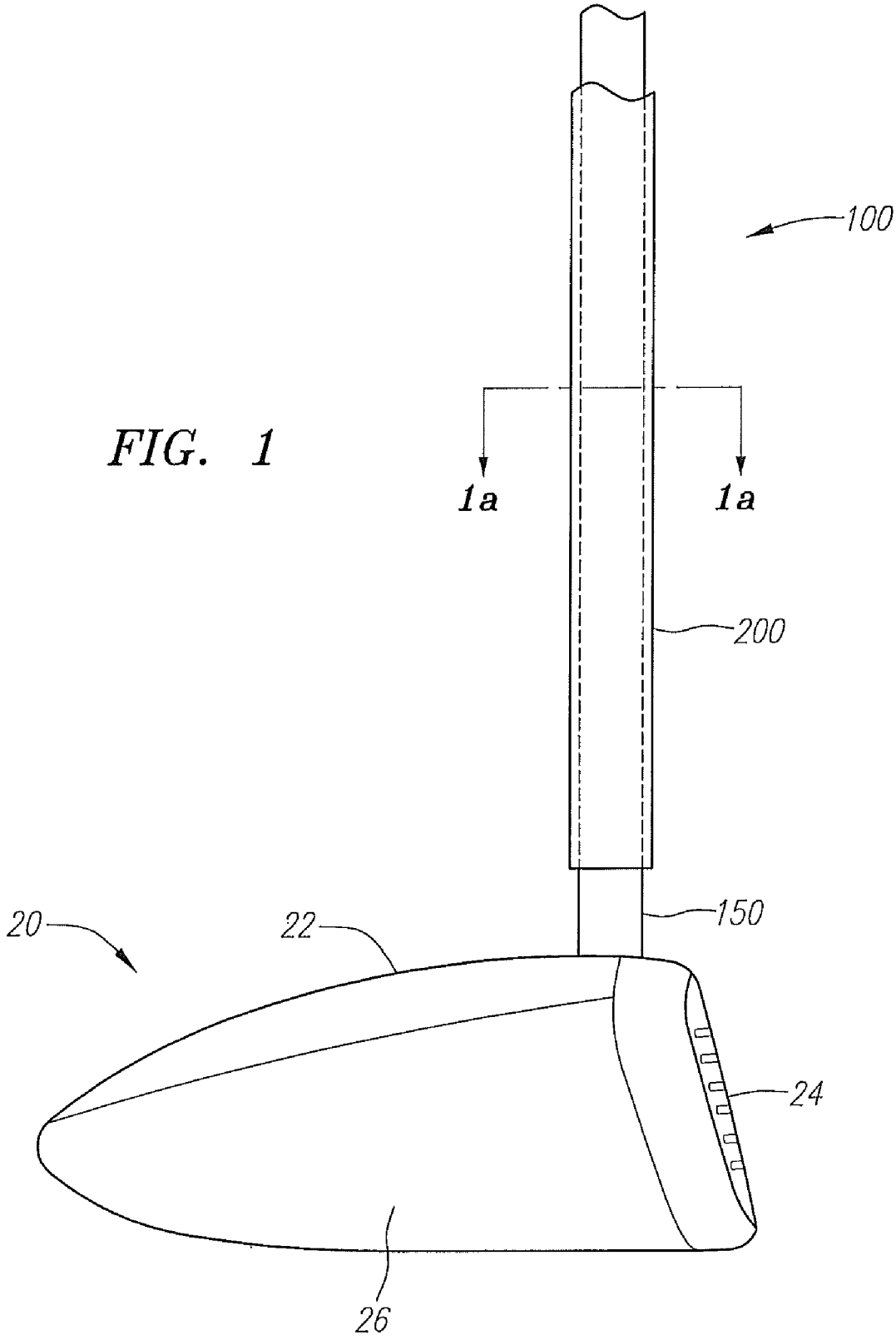
FIG. 1 is a perspective view of the invention.
Figure 1A:
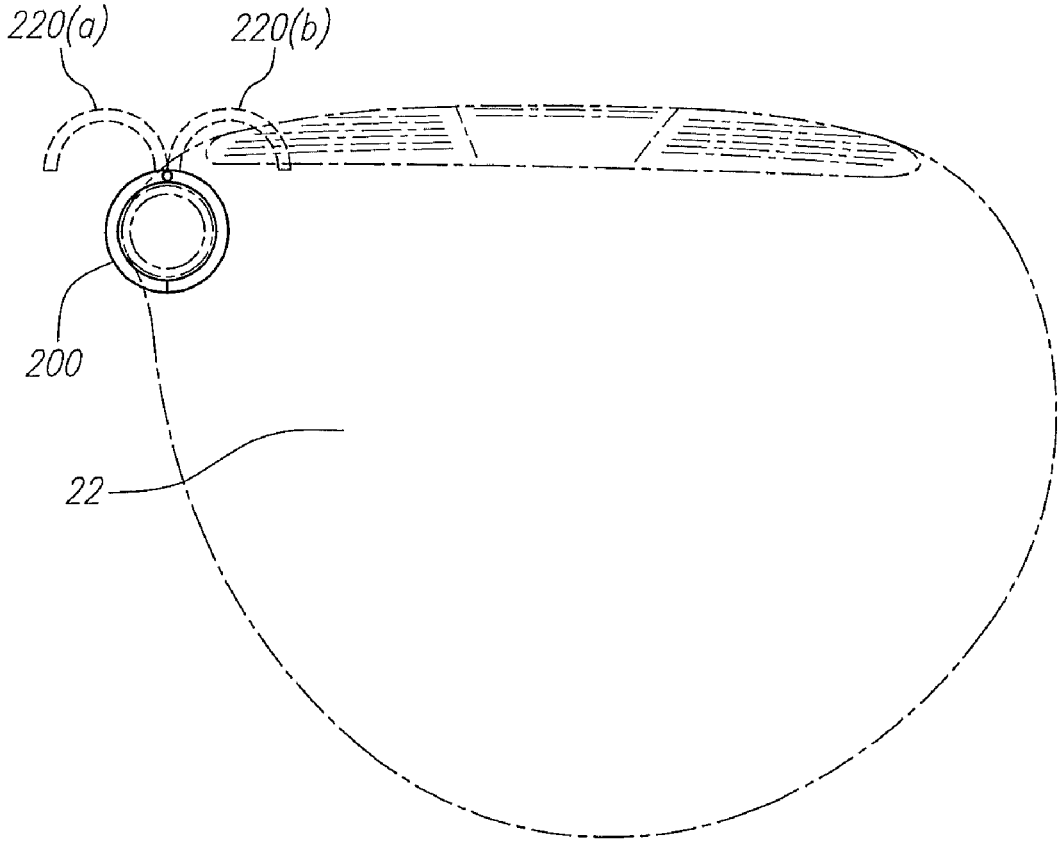
FIG. 1*a* is a top plan view of the invention which is deployed when the golf club is in backswing.
Figure 2:
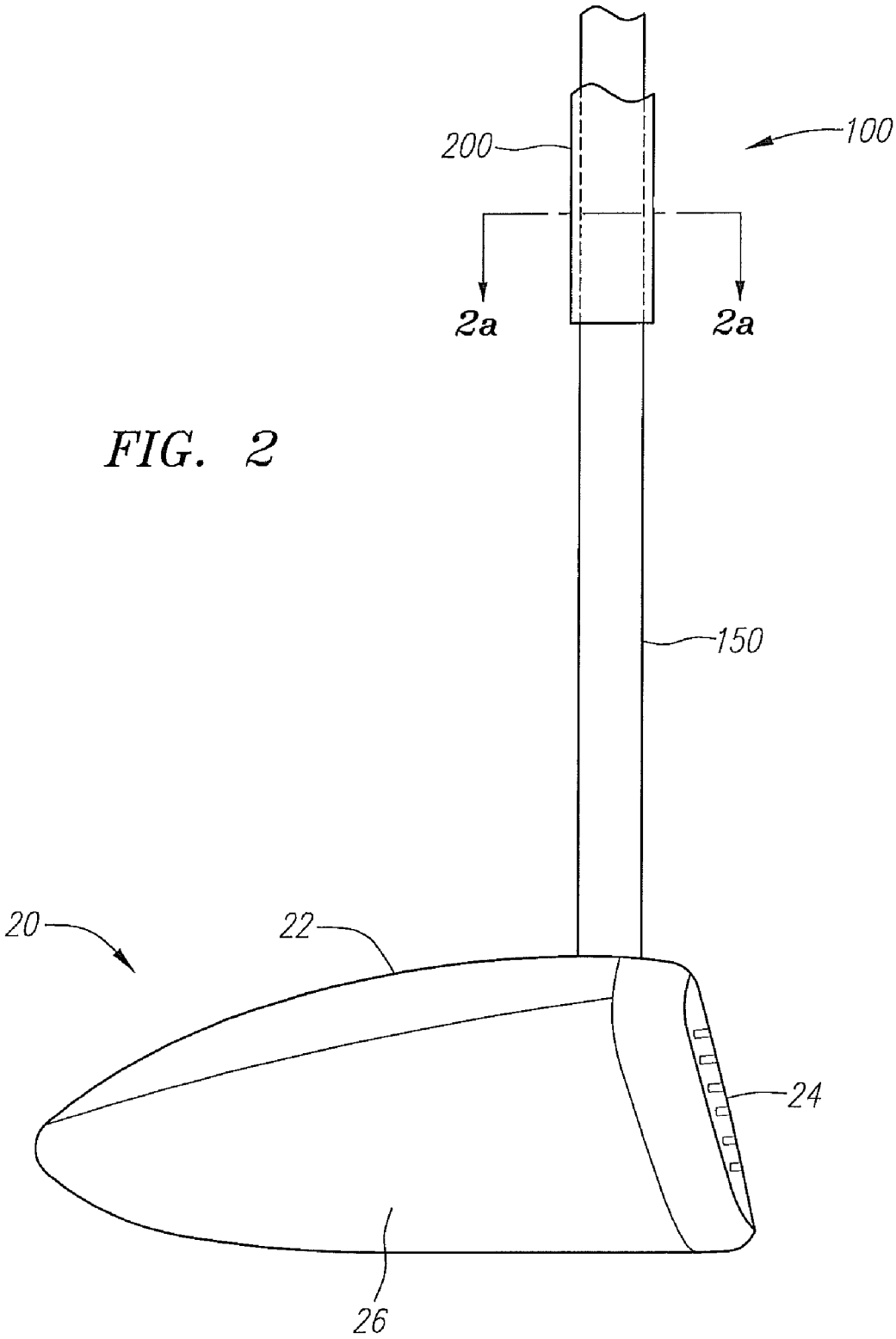
FIG. 2 is a view of the invention.
Figure 2A:
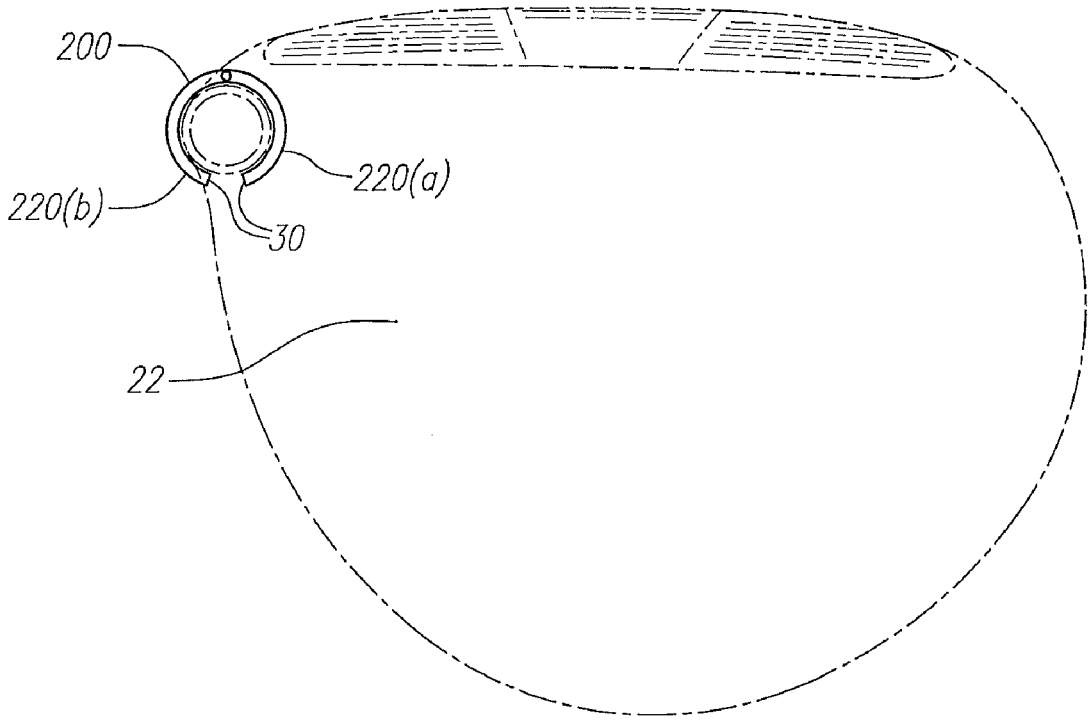
FIG. 2*a* is a top plan view of the invention while the golf club is in downswing or the golf club head is at address.

The invention preferably includes semi-fins that form a semi-circle and are mounted conformably about the shaft as shown in FIG. 1.

The present invention comprises golf club training aid 200 which comprises two deployable fins, 220(*a-b*) connected to a hinge 250. The hinge 250 is capable of attaching to a shaft 150 of a golf club 100. The fins 220(*a-b*) are deployable during a backswing and retractable during a downswing. The golf club 100 comprises a golf club head 20 with a crown component 22, face component 24, and ribbon section 26.

The invention adds a minimal amount of mass to a golf club, and functions automatically. The training aid 200 retards force in the golfer's back swing, but allows full swing speed in the golfer's down swing. The training aid 200 is preferably applied to a golf club with an adhesive tape and is removable. The training aid 200 is preferably made of a thermoset polymer or thermoplastic material. Different lengths are used to vary the degree of drag and torque. Such lengths comprise a full shaft length, a half shaft length, a quarter shaft length, and a one-eighth shaft length. Subtle edge shapes 30 modify timing of the deployment.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Hocknell, et al., U.S. Pat. No. 7,413,250 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club training aid for use with a golf club, comprising:

a plurality of deployable semi-circle fins connected to a main body, the main body removably connected to a shaft of a golf club, each of the deployable semi-circle fins deployable during a backswing and retractable during a downswing, the main body removably attached to the golf club at a connection of the shaft to a club head, the training aid extending along an ⅛ of the length of the shaft of the golf club, the plurality of deployable semi-circle fins and the main body composed of a thermoplastic material, wherein the training aid is utilized to assist in the proper rate and sequence of the closing of a club face of the club head to a golf ball via rotation of the golf club by triggering a torque that coerces the rotation.

* * * * *